United States Patent [19]

McAulay et al.

[11] Patent Number: 4,937,873

[45] Date of Patent: Jun. 26, 1990

[54] COMPUTATIONALLY EFFICIENT SINE WAVE SYNTHESIS FOR ACOUSTIC WAVEFORM PROCESSING

[75] Inventors: Robert J. McAulay, Lexington; Thomas F. Quatieri, Jr., Arlington, both of Mass.

[73] Assignee: Massachusetts Institute of Technology, Cambridge, Mass.

[21] Appl. No.: 179,528

[22] Filed: Apr. 8, 1988

Related U.S. Application Data

[63] Continuation-in-part of Ser. No. 712,866, Mar. 18, 1985, abandoned.

[51] Int. Cl.[5] ..... G10L 5/00

[52] U.S. Cl. ..... 381/51; 381/37

[58] Field of Search ..... 381/29–40, 381/46, 47, 50–53, 94

[56] References Cited

U.S. PATENT DOCUMENTS

| | | | |
|---|---|---|---|
| 3,296,374 | 6/1963 | Clapper | 381/50 |
| 3,360,610 | 12/1967 | Flanagan | 381/37 |
| 3,484,556 | 12/1964 | Flanagan et al. | 381/33 |
| 3,978,287 | 8/1976 | Fletcher et al. | 381/41 |
| 3,982,070 | 9/1976 | Flanagan | 381/51 |
| 4,034,160 | 7/1977 | Van Gerwen | 381/33 |
| 4,058,676 | 11/1977 | Wilkes et al. | 381/29 |
| 4,076,958 | 2/1978 | Fulghum | 381/51 |
| 4,701,953 | 10/1987 | White | 381/46 |
| 4,701,955 | 10/1987 | Taguchi | 381/51 |
| 4,752,956 | 6/1988 | Sluijter | 381/47 |

FOREIGN PATENT DOCUMENTS

WO86/05617 7/1978 World Int. Prop. O. .

OTHER PUBLICATIONS

Almeida et al., "Variable-Frequency Synthesis: An Improved Coding Scheme", IEEE ICASSP, Mar. 1984, pp. 1–4.

Crochiere, "A Weighted Overlap-Add Method of Short-Time Fourier Analysis/Synthesis", IEEE Trans. on ASSP, vol. ASSP-28, No. 1, Feb. 1980, pp. 99–102.

Hedelin, "A Tone-Oriented Voice-Excited Vocoder", Chalmers Univ. of Technology, CH1610-5, IEEE, 1981, pp. 205–208.

"A Tone-Oriented Voice-Excited Vocoder" Hedelin; Chalmers University of Technology, Gothenburg, Sweden, CH1610/5/81, pp. 205–208.

"A Representation of Speech With Partials", Hedelin; 1982, Elmevier Biological Press, The Representation of Speech in the Paripheral Auditory System, R. Carlson & B. Granstrom, pp. 247–250.

Malpass, "The Gold-Rabiner Pitch Detector In A Real Time Environment", *Proc. of EASCON* 1975 (Sep. 1975), pp. 1–7.

Gold, "Description of a Computer Program for Pitch Detection", *Fourth International Congress*, Copenhagen, Aug. 21–28, 1962.

(List continued on next page.)

*Primary Examiner*—Gary V. Harkcom
*Assistant Examiner*—David D. Knepper
*Attorney, Agent, or Firm*—Thomas J. Engellenner

[57] ABSTRACT

Methods and apparatus for reducing discontinuities between frames of sinusoidally modeled acoustic waveforms, such as speech, which occur when sampling at low frame rates. A Fast Fourier Transform-based overlap-add technique is applied to amplitude, frequency and phase components of sinusoidal waves after frame-to-frame sine wave matching has been performed. Matched sine wave amplitudes and frequencies are linearly interpolated and mid-point phase is estimated such that the mid-frame sine wave is best fit to the most recent half-frame segments of the lagging and leading sine waves. Synthetic mid-frame sine waves are generated using the interpolated amplitude and frequency and estimated phase values. Synthesized acoustic waveforms of high quality from original source waveforms can be produced in sinusoidal analysis/synthesis operations at coding frame rates of 50 Hz and lower. The methods and devices disclosed herein are particularly useful for computationally efficient coding and synthesis of speech waveforms.

26 Claims, 4 Drawing Sheets

OTHER PUBLICATIONS

Gold, "Note on Buzz-Hiss Detection", *J. Acoust. Soc. Am.*, vol. 36, No. 9, pp. 1659-1661, 1964.

Silverman et al., "Transfer Characteristic Estimation for Speech Via Multirate Evaluation", IEEE Publication 75 CHO 998-5 EASCON, 181-A to 181-F, Sep. 1975.

Holmes, "The JSRU Channel Vocoder", IEE Proc., vol. 127, No. 1 (Feb. 1960).

Rabiner et al., "*Digital Processing of Signals*", pp. 225-238 (1978).

Markel, Excerpt from *Linear Prediction of Speech*, pp. 227-262 (1967).

Crochiere, "A Weighted Overlap-Add Method . . . ", *IEEE* 1980, pp. 99-102.

McAulay et al., "Mid-Rate Coding Based on a Sinusoidal Representation of Speech", ICASSP'85, Tampa, Fla., Mar. 26-29, 1985.

Quatieri et al., "Low-Peak-Factor Speech Waveforms by Pulse Compression Design", *IEEE ASSP*, p. 29, May 15 & 16, 1987.

Quatieri et al., "Speech Transformations Based on a Sinusoidal Representation", IEEE Trans. on Acoustics, vol. ASSP-34, No. 6 (Dec. 1986).

Quatieri et al., "Mixed-Phase Deconvolution of Speech Based on a Sine-Wave Model", Presented at ICASSP, Dallas, Tex. (Apr. 6-9, 1987).

McAulay et al., "STC: A Multirate Coder Operating at 2.4-8.0 KBPS", Presented at Speech Tech 87, New York City, N.Y., Apr. 1987.

McAulay et al., "Multirate Sinusoidal Transform Coding at Rates from 2.4 KBPS to 8 KBPS", Presented at ICASSP 87, Dallas, Tex. (Apr. 6-9, 1987).

McAulay et al., "Speech Analysis/Synthesis Based on a Sinusoidal Representation", *IEEE* 1986, pp. 744-754 (Aug. 1986).

McAulay et al., "Phase Modelling and its Application to Sinusoidal Transform Coding", Presented at ICASSP'86, Tokyo, Japan (Apr. 8-11, 1986).

Quatieri et al., "Speech Transformations Based on a Sinusoidal Representation", ICASSP-IEEE Int'l. Conf. (Mar. 2614 29, 1985).

Quatieri et al., "Speech Enhancement for AM Radio Broadcasting", *Military Speech Tech*'87 (Nov. 17-19, 1987).

Almeida et al., "Variable-Frequency Synthesis: An Improved Harmonic Coding Scheme", ICASSP 84, vol. 2 of 3, *IEEE Int'l. Conf. On Acoustics, Speech.*

COMPUTATIONALLY EFFICIENT SINE WAVE SYNTHESIS FOR ACOUSTIC WAVEFORM PROCESSING

The U.S. Government has rights in this invention pursuant to the Department of the Air Force Contract No. F19-028-85-C-0002.

REFERENCE TO RELATED APPLICATION

This application is a continuation-in-part of U.S. Ser. No. 712,866, "Processing of Acoustic Waveforms," filed Mar. 18, 1985, incorporated herein by reference, now abandoned. This case is also related to Ser. No. 07/339,957 now U.S. Pat. No. 4,885,790.

BACKGROUND OF THE INVENTION

The field of this invention is speech technology generally and, in particular, methods and devices for analyzing, digitally encoding and synthesizing speech or other acoustic waveforms.

Systems for digital encoding and synthesis of speech are the subject of considerable present interest, particularly at rates compatible with existing transmission lines, which commonly carry digital information at 2.4–9.6 kilobits per second. At such rates, conventional systems based upon speech waveform modeling are inadequate for coding applications and yield poor quality speech transmission, even if linear predictive coding (LPC) and other efficient coding techniques are used.

Typically, the problem of representing speech signals is approached by using a speech production model in which speech is viewed as the result of passing a glottal excitation waveform through a time-varying, linear filter that models the resonant characteristics of the vocal tract. In a so-called "binary excitation model," it is assumed that the glottal excitation can be in one of two possible states corresponding to voiced or unvoiced speech.

In the voiced speech state, the excitation is periodic with a period which is allowed to vary slowly over time relative to the analysis frame rate, typically 10–20 msecs For the unvoiced speech state, the glottal excitation is modeled as random noise with a flat spectrum In both cases, the power level in the excitation is also considered to be slowly time-varying.

While this binary model has been used successfully to design narrowband vocoders and speech synthesis systems, its limitations are well known. For example, the speech excitation is often mixed, having both voiced and unvoiced components simultaneously, and often only portions of the spectrum are truly harmonic. Additionally, the binary model requires that each frame of data be classified as either voiced or unvoiced, a decision which is difficult to make if the speech is subject to additive acoustic noise.

The above-referenced parent application, U.S. Ser. No. 712,866, discloses an alternative to the binary excitation model in which speech analysis and synthesis, as well as coding, can be accomplished simply and effectively by employing a time-frequency representation of the speech waveform which is independent of the speech state. In particular, a sinusoidal model for the speech waveform is utilized to develop a new analysis and synthesis method.

The basic method of U.S. Ser. No. 712,866 includes the steps of (i) selecting frames—i.e. windows of approximately 20–60 milliseconds—of samples from the waveform; (ii) analyzing each frame of samples to extract a set of frequency components; (iii) tracking the components from one frame to the next; and (iv) interpolating the values of the components from one frame to the next to obtain a parametric representation of the waveform. A synthetic waveform can then be constructed by generating a set of sine waves corresponding to the parametric representation. The disclosures of U.S. Ser. No. 712,866 are incorporated herein by reference.

In one illustrated embodiment described in detail in U.S. Ser. No. 712,866, the basic method is utilized to select amplitudes, frequencies and phases corresponding to the largest peaks in a periodogram of the measured signal, independently of the speech state. In order to reconstruct the speech waveform, the amplitudes, frequencies and phases of the sine waves estimated on one frame are matched and allowed to continuously evolve into the corresponding parameter set on the next frame.

Because the number of estimated peaks is not constant and is slowly varying, the matching process is not straightforward. Rapidly varying regions of speech, such as unvoiced/voiced transitions, can result in large changes in both the location and number of peaks.

To account for such rapid movements in spectral energy, the concept of "birth"0 and "death" of sinusoidal components is employed in a nearest-neighbor matching method based on the frequencies estimated on each frame. If a new peak appears, a "birth" is said to occur and a new track is initiated. If an old peak is not matched, a "death" is said to occur and the corresponding track is allowed to decay to zero.

Once the parameters on successive frames have been matched, phase continuity of each sinusoidal component is ensured by unwrapping the phase. In one embodiment described in U.S. Ser. No. 712,866, the phase is unwrapped using a cubic phase interpolation function having parameter values that are chosen to satisfy the measured phase and frequency constraints at the frame boundaries while maintaining maximal smoothness over the frame duration.

In the final step of the illustrated embodiment, the corresponding sinusoidal amplitudes are interpolated in a linear manner across each frame.

In speech coding applications, U.S. Ser. No. 712,866 teaches that pitch estimates can be used to establish a set of harmonic frequency bins to which frequency components are assigned. The term "pitch" is used herein to denote the fundamental rate at which a speaker's vocal chords are vibrating. The amplitudes of the components are coded directly using adaptive differential pulse code modulation (ADPCM) across frequency, or indirectly using linear predictive coding (LPC).

In one embodiment of the coder, the peak in each harmonic frequency bin having the largest amplitude is selected and assigned to the frequency at the center of the bin. This results in a harmonic series based upon the coded pitch period. An amplitude envelope can then be constructed by connecting the resulting set of peaks and later sampled in a pitch-adaptive fashion (either linearly or non-linearly) to provide efficient coding at various bit rates. The phases can then be coded by measuring the phases of the edited peaks and then coding such phases using 4 to 5 bits per phase peak. Further details on coding acoustic waveforms in accordance with applicants' sinusoidal analysis techniques can be found in commonly-owned, copending U.S. patent application Ser. No. 034,097, entitled "Coding of Acoustic Waveforms," incorporated herein by reference.

Analysis/synthesis systems constructed according to the invention disclosed in U.S. Ser. No. 712,866, based on a sinusoidal representation of speech, yield synthetic speech that is essentially indistinguishable from the original. Coding techniques as disclosed in U.S. Ser. No. 034,097 have led to the realization of multi-rate coders operating at rates from 2.4 to 9.6 kilobits per second. Such systems produce synthetic speech that is very intelligible at all rates and, in general, produce speech having progressively improving quality as the data rate is increased.

A practical limitation of the sinusoidal technique has been the computational complexity required to perform the sinusoidal synthesis. This complexity results because it is typically necessary to generate each sine wave on a per-sample basis and then sum the resulting set of sine waves. Good performance can be achieved in sinusoidal analysis/synthesis while operating at a 50 Hz frame rate, provided that the sine wave frequencies are matched from frame to frame and that either cubic phase or piece-wise quadratic phase interpolators are used to ensure consistency between the measured frequencies and phases at the frame boundaries. The disadvantage of this approach is the computational overhead associated with the interpolation process. Even if very powerful 125 nanosecond/cycle microprocessors are utilized, such as the ADSP2100 DSP integrated circuits manufactured by Analog Devices (Norwood, Mass.), two such microprocessors typically are required to synthesize 80 sine waves.

An alternative method for performing sinusoidal synthesis includes constructing a set of sine waves having constant amplitudes, frequencies and linearly-varying phases, applying a triangular window of twice the frame size, and then utilizing an overlap-and-add technique in conjunction with the sine waves generated on the previous frame. Such a set of sine waves can also be generated using conventional Fast Fourier Transform (FFT) methods. In this approach, a Fast Fourier Transform (FFT) buffer is filled out with non-zero entries at the sine wave frequencies, an inverse FFT is executed, and then the overlap-and-add technique is applied. This process also leads to synthetic speech that is perceptually indistinguishable from the original, provided the frame rate is approximately 100 Hz (10 ms/frame).

However, for low-rate coding applications, it is necessary to operate at a 50 Hz frame rate (20 ms/frame) or lower. At these frame rates, the FFT overlap-and-add method yields synthetic speech that sounds "rough" because the triangular parametric window is at least 40 ms wide, and this is too long a period compared to the rate of change of the vocal tract and vocal chord articulators.

An apparatus for computationally efficient coding of acoustic waveforms at frame rates of 50 Hz or less, without the "roughness" produced at low coding rates by the above-described methods, would meet a substantial need. In particular, speech processing devices and methods that reduce frame-to-frame discontinuities at low coding rates would be particularly advantageous for coding of speech.

Accordingly, there exists a need for computationally efficient methods and devices for synthesizing sine waves for speech coding, analysis and synthesis systems which operate at low coding rates requiring frame rates of 50 Hz and below. In particular, techniques and apparatus for efficient synthesis of sine waves in connection with sinusoidal transform coding would satisfy long-felt needs and provide substantial contributions to the art.

SUMMARY OF THE INVENTION

Sine wave synthesis and coding systems are further disclosed for processing acoustic waveforms based on Fast Fourier Transform (FFT) overlap-and-add techniques. A technique for sine wave synthesis is disclosed which relieves computational choke points by generating mid-frame sine wave parameters, thereby reducing frame-to-frame discontinuities, particularly at low coding rates. The technique is applied to the sinusoidal model after the frame-to-frame sine wave matching has been performed. Mid-frame values are obtained by linearly interpolating the matched sine wave amplitudes and frequencies and estimating a mid-point phase, such that the mid-frame sine wave is best fit to the most recent half-frame segments of the lagging and leading sine waves.

For example, the invention provides methods and apparatus for receiving sets of sine wave parameters every 20 ms and for implementing an interpolation technique that allows for resynthesis every 10 ms.

In synthesizing the mid-frame sine wave components, the mid-frame phase can be estimated as follows:

$$\overline{\theta}(M)=(\theta_o+\theta_1)/2+(\omega_o-\omega_1)/2.N/4+\pi M$$

where M is an integer whose value is chosen such that $\pi M$ is closest to $$(\theta_o-\theta_1)/2+(\omega_o+\omega_1)/2.N/4$$

and where $\theta_o$ is the phase of the lagging frame, $\theta_1$ is the phase of the leading frame, $\omega_o$ is the frequency of the lagging frame, $\omega_1$ is the frequency of the leading frame, and N is the analysis frame length.

In another aspect of the invention, a system is disclosed which provides improved quality, particularly for low-rate speech coding applications where the speech has been corrupted by additive acoustic noise. For high pitched speakers especially, background noise can have a tonal quality when resynthesized that can be annoying if the signal-to-noise (SNR) ratio is low. When a pitch-adaptive analysis window is used, the window will be short for high pitched speakers and, when applied to the noise, will result in relatively few resolved sine waves. The resulting synthetic noise then sounds tonal. In addition to reducing the frame-to-frame discontinuities, the present invention suppresses this tonal noise and replaces it with a more "noise-like" signal which improves the robustness of the system.

In one embodiment of the noise compensating system, the receiver can employ a voicing measure to determine highly unvoiced frames (i.e., noisy frames), and the spectra for successive noisy frames can then be averaged to obtain an average background noise spectrum. This information can be used to suppress the synthesized noise at the harmonics in accordance with the SNR at each harmonic and used to replace the suppressed noise with a broad band noise having the same spectral characteristic.

Methods are also disclosed for phase regeneration of sine waves for which no phase coding is possible. At low data rates (e.g., 2.4 kbps and below), it is typically not possible to code any of the sine wave phases. Thus, in another aspect of the invention, techniques are disclosed to reconstruct an appropriate set of phases for use in synthesis, based on an assumption that all the sine waves should come into phase every pitch onset time. Reconstruction is achieved by defining a phase function for the pitch fundamental obtained by integration of the instantaneous pitch frequency.

The invention will next be described in connection with certain illustrated embodiments. However, it should be clear that various changes and modifications can be made by those skilled in the art without departing from the spirit and scope of the invention, as defined by the claims. For example, although the description that follows is particularly adapted to speech coding, it should be clear that various other acoustic waveforms can be processed in a similar fashion.

BRIEF DESCRIPTION OF THE DRAWINGS

For a more thorough understanding of the nature and objects of the invention, reference should be had to the following detailed description and to the drawings, in which.

DETAILED DESCRIPTION

In the present invention the speech waveform is modeled as a sum of sine waves. If s(n) represents the sampled speech waveform, then $$s(n)=\Sigma A_i(n)\cos[\theta_i(n)] \quad (1)$$

where $A_i(n)$ and $\theta_i(n)$ are the time-varying amplitudes and phases of the i'th tone.

To obtain a representation of the waveform over time, frequency components measured on one analysis frame must be matched with frequency components that are obtained on a successive frame. In particular, a frequency component from one frame must be matched with a frequency component in the next frame having the "closest" value. The matching technique is described in more detail in parent case U.S. Ser. No. 712,866, herein incorporated by reference. Once matched, the values of the components from one frame to the next must be interpolated to obtain a parametric representation in which the sine waves of one frame evolve into the corresponding parameter set of the next frame.

Figure 1:
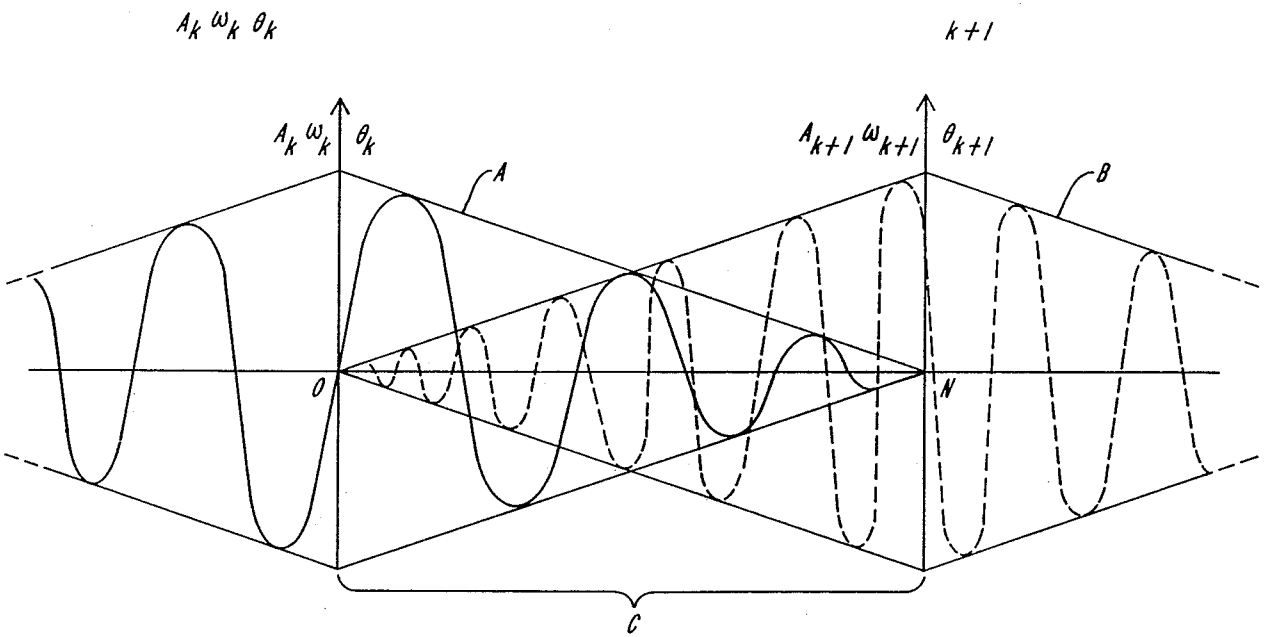
FIG. 1 is an illustration of a simple overlap-and-add interpolation technique in accordance with the invention, showing a triangular parametric window applied to sine wave parameters obtained at frame boundaries to generate interpolated values between those measured at frame boundaries.

FIG. 1 illustrates the basic process of interpolating exemplary frequency components for frames K and K+1 in accordance with the invention by the overlap-and-add method. The triangular windows A and B shown in FIG. 1 are used to interpolate the sine wave components from frame K to frame K+1. In the overlap-and-add method of filling in data values, the triangular window is applied to the resulting sine waves generated during each frame. The overlapped values in region C are then summed to fill in the values between those measured at the frame boundaries.

The overlap/add technique illustrated in FIG. 1 yields good performance for sampling rates near 100 Hz, i.e. 10 ms frames. However, for most coding applications, sampling rates of approximately 50 Hz, i.e. 20 ms frames, are required When the overlap-and-add interpolation technique shown in FIG. 1 is used, in this case, the triangular window is effectively 40 ms wide, which assumes a stationarity that is too long relative to the rate of change of the human vocal tract and vocal chord articulators, and significant frame to frame discontinuities result. Thus, a further preferred embodiment of the invention provides a method for minimizing such discontinuities.

If $A_o$, $\omega_o$, and $\theta_o$ represent the amplitude, frequency and phase of a sine wave on frame K and $A_1$, $\omega_1$, and $\theta_1$ represent the amplitude, frequency and phase of the matched sine wave on frame K+1, then the equations:

$$\bar{A}=(A_o+A_1)/2 \quad (2)$$

and $$\bar{\omega}=(\omega_o+\omega_1)/2 \quad (3)$$

represent a good approximation of the true amplitude and frequency at the mid-point between frame K and frame K+1. Equations 2 and 3 represent one set of interpolation functions which can be used to fill in data values between those measured at frame boundaries.

In order to minimize any discontinuity between the sine wave at frame K and its transition to the synthetic sine wave at the mid-point and between the synthetic sine wave and its transition to the sine wave at frame K+1, the invention calculates a phase that yields the minimum mean-squared-error at times N/4 and 3N/4, where N is the analysis frame length. This phase is calculated according to the equation:

$$\theta(\bar{M})=(\theta_o+\theta_1)/2+(\omega_o-\omega_1)/2.N/4+\pi M \quad (4)$$

where M is an integer whose value is chosen, such that $\pi M$ is closest to $$(\theta_o-\theta_1)/2+(\omega_o+\omega_1)/2.N/4 \quad (5)$$

Figure 2:
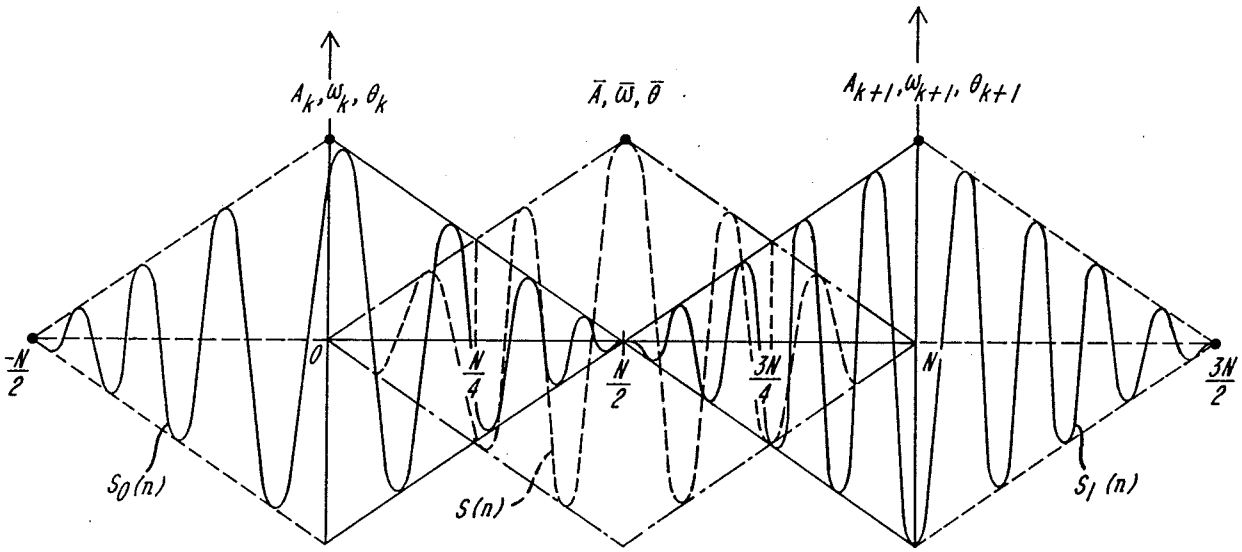
FIG. 2 is an illustration of a further application of overlap-and-add interpolation techniques according to the invention, showing the generation of an artificial mid-frame sine wave to reduce the discontinuities in the resynthesized waveform at low coding rates.

In accordance with this preferred embodiment of the invention, an artificial set of mid-frame sine waves is generated by applying the above interpolation rules for all of the matched sine waves and then applying a conventional FFT overlap-and-add technique. FIG. 2 illustrates this overlap-and-add interpolation technique, showing an artificial sine wave between frame K and frame K+1. The artificial sine wave $\bar{S}(n)$, generated with values provided by the above interpolation rules, reduces the discontinuities between $S_o(n)$ and $S_1(n)$ shown in FIG. 2. Because the effective stationarity has been reduced from 40 ms to 20 ms, the resulting synthetic speech is no longer "rough." Hence, the invention provides a method for doubling the effective synthesis rate with no increase in the actual transmission frame rate.

Figure 3:
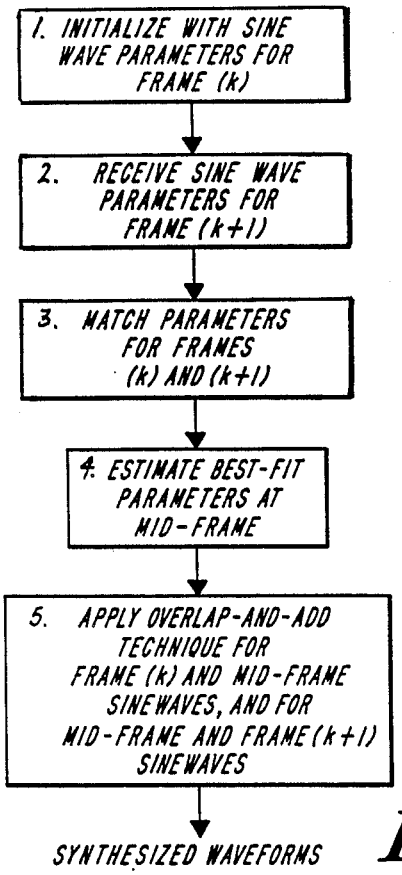
FIG. 3 is a flow chart showing the steps of a method of mid-frame sine wave synthesis according to the invention.

In FIG. 3, a flow chart of the processing steps for interpolation using synthetic mid-frame parameters according to the invention is shown. Sine wave parameters for each frame are received and sampled every T ms, where T is the frame period for frames K and K+1. The sine wave parameters include amplitude A, frequency $\omega$ and phase $\theta$. As shown in FIG. 3, the interpolation procedure begins in step 1 with the sine wave parameters for frame K which are used to initialize the process. Next in step 2, the sine wave parameters for frame K+1 are received.

The frequency components for frames K and K+1 are then matched in step 3, preferably according to the method described in U.S. Ser. No. 712,866, and in step 4 a mid-frame sine wave is constructed having an amplitude and frequency given by Equations 2 and 3, and a phase is estimated for each sine wave component, in accordance with Equation 4 above, such that each mid-frame sine wave is best fit to the most recent half-frame segments of the lagging and leading sine waves.

Finally in step 5, the overlap-and-add technique is applied to interpolate between the frame K and mid-frame values and, likewise, to interpolate between the mid-frame and frame K+1 values in order to synthesize a set of waveforms at a virtual rate of T/2 ms. Thus, the synthetic waveform reduces the discontinuities between the frame K and frame K+1 waveforms, in effect generating an artificial frame half the duration of the actual frame.

Figure 4:
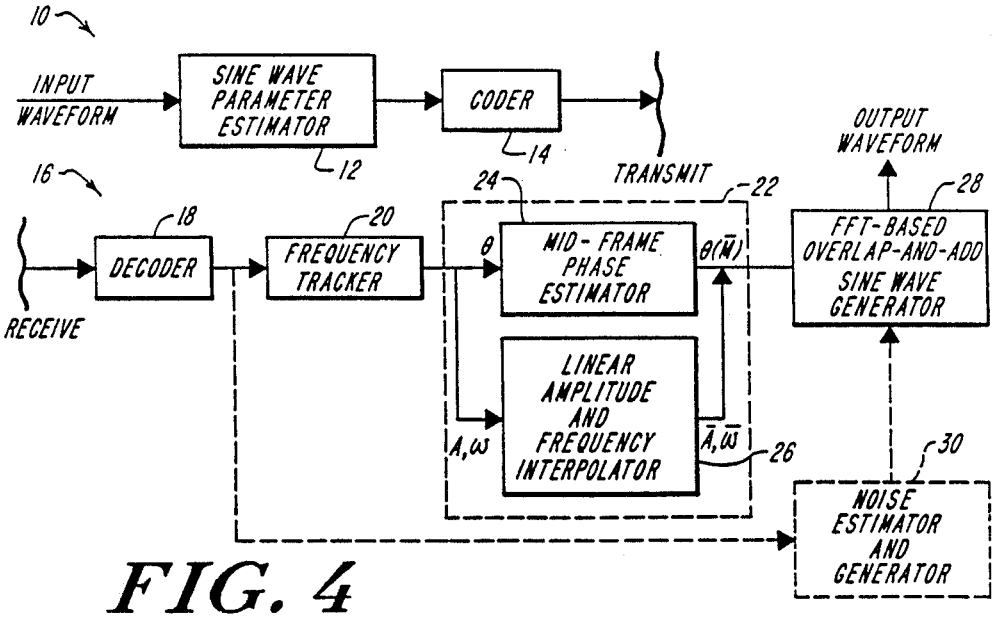
FIG. 4 is a schematic block diagram of a mid-frame sine wave synthesis system according to the invention.

FIG. 4 is a block diagram of an acoustic waveform processing apparatus, according to the invention. The transmitter 10 includes sine waves parameter estimator 12 which samples the input acoustic waveform to obtain a discrete samples and generates a series of frames, each frame spanning a plurality of samples. The estimator 12 further includes means for extracting a set of frequency components having discrete amplitudes and phases. The amplitude, frequency and phase information extracted from the sampled frames of the input waveform is coded by coder 14 for transmission. The sampling, analyzing and coding functions of elements 12 and 14 are more fully discussed in U.S. Ser. No. 712,866, as well as U.S. Ser. No. 034,097 also incorporated herein by reference.

In the receiver section 16, the coded amplitude, frequency and phase information is decoded by decoder 18 and then analyzed by frequency tracker 20 to match frequency components from one frame to the next.

The interpolator 22 interpolates the values of components from one frame to the next frame to obtain a parametric representation of the waveform, so that a synthetic waveform can be synthesized by generating a set of sine waves corresponding to the interpolated values of the parametric representation In a preferred embodiment of the invention, the interpolator 22 includes a mid-frame phase estimator 24 which implements a "best fit" phase calculation, in accordance with Equations 4 and 5 above, and a linear interpolator 26, which linearly interpolates matched amplitude and frequency components from one frame to the next frame. The apparatus 16 further includes an FFT-based sine wave generator 28 which performs an overlap-and-add function utilizing Fourier analysis.

The generator 28 further includes means for filling a buffer with amplitude and phase values at the sine wave frequencies, means for taking an inverse FFT of the buffered values, and means for performing an overlap-and-add operation with transformed values and those obtained from the previous frame.

Moreover, as shown generally in FIG. 4, the apparatus 10 can also optionally include a noise estimator and generator 30. For high-pitched speakers especially, the background noise has a tonal quality that can become quite annoying, particularly when the signal-to-noise ration (SNR) is low. The noise dependence on pitch is due to the fact that the analysis window typically is set at two and one-half times the average pitch. Hence, for a high-pitched speaker, the window will be short (but no less than 20 ms) which, when applied to the noise, results in relatively few resolved sine waves. The resulting synthetic noise then sounds tonal. Conversely, for low-pitched speakers, the window will be quite long. This results in a more resolved noise spectra which leads to a larger number of sine waves for synthesis, which in turn, sounds more "noise-like," that is to say, less tonal.

Figure 5:
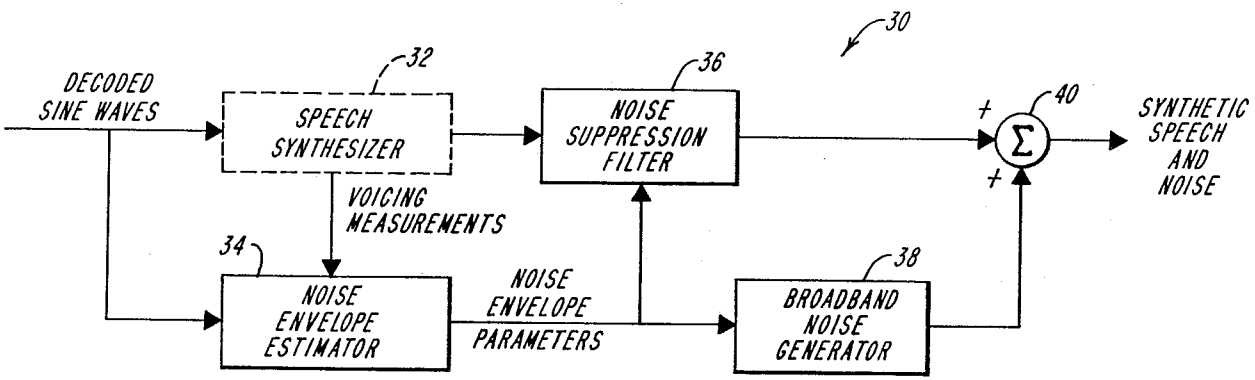
FIG. 5 is a further schematic block diagram showing a noise suppressing receiver structure according to the invention.

In FIG. 5, a noise correction system 30 according to the invention is shown in more detail. The noise correction system 30 operates in concert with a speech (or other acoustic waveform) synthesizer 32 (e.g., frequency tracking, interpolating and sine wave generating circuitry as described above in connection with FIG. 4), and includes a noise envelope estimator 34, a noise suppression filter 36, a broadband noise generator 38, and a summer 40. The noise envelope estimator 34 estimates the noise envelope parameters from decoded sine waves and voicing measurements, as discussed in more detail below. These noise envelope parameters drive the noise suppression filter 36 to modify the waveforms from synthesizer 32 and also drive the broadband noise generator 38. The modified, synthetic waveforms and broadband noise are then added in summer 40 to obtain the output waveform in which "tonal" noise is essentially eliminated.

Although the noise correction system 30 is illustrated by discrete elements, it should be apparent that the functions of some or all of these elements can be combined in operation. For example, the noise correction system can be implemented as part of the synthesizer, itself, by applying noise attenuation factors to the harmonic entries in a FFT-buffer during the synthesis operations and implementation of the broadband noise can be accomplished by adding predetermined randomizing factors to the amplitudes and phases of all of the FFT buffer entries prior to synthesis.

Since the system of the present invention is essentially linear, the envelope of the speech plus noise spectra and the envelope of the noise spectra are correctly replicated at the receiver. Since the coder also transmits a measure of the probability that any given frame of speech is voiced, it is possible to average those spectra for which strong voicing is unlikely. This results an an estimate of the envelope of the spectrum of the background noise. A synthetic noise waveform can then be generated by creating another FFT buffer with complex entries at every frequency using random phases that are uniformly distributed over $[0,2\pi]$, and random aplitudes that are uniformly distributed over $[O,N(\omega)]$ where $N(\omega)$ is the value of the average background noise envelope at each FFT frequency point, $\omega$. This buffer can then be added to the pitch-dependent FFT buffer.

One method to this straightforward addition is the fact that the noise would already have been replicated at the harmonic frequencies and in some sense, would have been duplicated in the synthesis process. This problem can be avoided by using a modest amount of noise suppression by any of various techniques known to those skilled in the art. For example, the SNR can be measured and the gain attenuated by a function of the SNR, such that, if the SNR is high, little attenuation is imposed, while if the SNR is low, attenuation is increased.

Since the noise spectrum is known at the receiver, the average background noise energy can be computed. If this is denoted by $$E_n = \int_o^{\pi} N(\omega)d\omega \tag{6}$$

and if $$E_y = \int_o^{\pi} Y(\omega)d\omega \tag{7}$$

denotes the total energy in the envelope of the speech plus noise on any given frame, then the SNR can be calculated using $$SNR = \frac{E_y - E_n}{E_n} \tag{8}$$

The output signal level can then be modified according to the rule $$Y'(\omega) = Y(\omega)G(\omega) \tag{9}$$

where the gain $G(\omega)$ at frequency $\omega$ is given by the simple noise-suppression characteristics $$\log[G(\omega)] = \begin{cases} \alpha[\log(SNR) - \log(SNR_o)] \text{ for } SNR \leqq SNR_o \\ O \text{ otherwise} \end{cases} \tag{10}$$

where the transition at $\log(SNR_o)$ is chosen to correspond to about a 3 dB SNR and the slope, $\alpha$, is chosen according to the degree of noise suppression desired. (Usually only a modest slope is used ($\simeq$1)). This gain is applied to the amplitudes at the pitch harmonics, and the signal level is suppressed depending on the amount the SNR is below the 3 dB level. Therefore, if speech is absent on any given frame, the amplitude entries for the harmonic noise will be suppressed, and when the resulting buffer is added to the synthetic noise buffer, the final contribution to the synthesized noise will be given mainly by the average background noise envelope. On the other hand, if speech is present that exceeds the 3 dB level, it is synthesized at the measured level and then added to the synthetic noise. Since this noise will always be at least 3 dB lower than the speech, it will not seriously affect the speech waveform.

This enhancement system was incorporated into the real-time program and was found to dramatically improve the quality of the synthesized noisy speech. After a short adaption time ($\simeq$1 sec), the tonal noise was essentially eliminated, having been replaced by colored noise that was truly "noise-like."

At low data rates ($\simeq$2.4 kbps), it is not possible to code any of the sine-wave phases. Techniques have been developed to reconstruct an appropriate set of phases for use in synthesis, based on the idea that all of the sine waves should come into phase every pitch-onset time. (See U.S. Ser. No. 034,097 for further details.) It was shown that this property could be achieved by defining a phase function for the pitch fundamental that was obtained by integrating the instantaneous pitch frequency, which in turn was defined to be the linear interpolation between the matched fundamental frequencies at frame K and frame K+1. This means that the phase track would be quadratic over the synthesis frame, a condition that was easily realized in the sample-base approach to sine-wave synthesis using Equation (1).

With the FET/overlap-add synthesizer, however, the phase variation can, at most, be piecewise linear. Therefore, rather than use the quadratic phase model to produce an endpoint phase and then produce a midpoint phase for the FFT/overlap-add method using Equation (4), it is preferable to introduce a new phase track for the fundamental frequency which is simply the integral of the piecewise constant frequencies.

The onset times for the mid-point since waves and for the frame K+1 since waves (denoted by $\bar{n}_o$ and $n_o^{K+1}$) can be found by locating the times at which this phase function crosses the nearest multiple of $2\pi$. The sine-wave phases at each frequency $\omega$ can then be determined using the linear phase models:

$$\theta(\omega) + n_o\omega \tag{11}$$

$$\theta_{K+1}(\omega) = n_o^{K+1}\omega \tag{11}$$

It will be understood that changes may be made in the above construction and in the foregoing sequences of operation without departing from the scope of the invention. It is, accordingly, intended that all matter contained in the above description or shown in the accompanying drawings be interpreted as illustrative rather than in a limiting sense.

It is also understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A method of processing an acoustic waveform, the method comprising:

sampling a waveform to obtain a series of discrete samples and constructing therefrom a series of frames, each frame spanning a plurality of samples;

analyzing each frame of samples to extract a set of variable frequency components having individual amplitudes;

tracking said components from one frame to a next frame, said tracking including matching a component from the one frame with a component in the next frame having a similar value regardless of shifts in frequency and spectral energy; and interpolating the values of the components from the one frame to the next frame by performing an overlap-and-add function utilizing Fourier analysis to generate a reconstruction of said waveforms.

2. The method of claim 1 wherein said interpolating step further includes estimating mid-frame values and interpolating between said mid-frame values and values obtained during each frame in order to generate a refined representation of the waveform.

3. The method of claim 2 wherein said estimating step further includes deriving mid-frame amplitude and frequency values by linear interpolation of lagging and leading sine waves.

4. The method of claim 2 wherein said estimating step further includes providing a mid-frame phase value such that the sine wave corresponding to the interpolated mid-frame values of the parametric representation is best fit to predetermined segments of lagging and leading sine waves.

5. The method of claim 2 wherein said estimating step further includes deriving mid-frame phase values from the lagging and leading sine waves according to the following equation $$\theta(\overline{M})=(\theta_o+\theta_1)/2+(\omega_o-\omega_1)/2.N/4+\pi M$$

where M is an integer whose value is chosen, such that $\pi M$ is closest to $$(\theta_o-\theta_1)/2+(\omega_o+\omega_1)/2.N/4$$

and where $\theta_o$ is the phase of the lagging frame, $\theta_1$ is the phase of the leading frame, $\omega_o$ is the frequency of the lagging frame, $\omega_1$ is the frequency of the leading frame, and N is the analysis frame length.

6. The method of claim 1 wherein the method further includes suppressing tonal noise values.

7. The method of claim 6 wherein the method further includes estimating a noise envelope and using said noise envelope estimate to drive a noise suppression filter.

8. The method of claim 6 wherein the method further includes generating broadband noise to replace said suppressed noise values.

9. A method for suppressing tonal noise artifacts during the reconstruction of an acoustic waveform from a sinusoidal parametric representation of the waveform, the method comprising;

estimating a noise envelope from a set of variable frequency components having individual amplitudes which comprise a parametric representation of the waveform;

reconstructing an acoustic waveform from said parametric representation; and filtering said reconstructed waveform using said noise envelope estimates to suppress tonal noise estimates.

10. A method of deriving phase values for frequency components during reconstruction of an acoustic waveform from a sinusoidal representation of the waveform, the method comprising:

determining a phase of the fundamental frequency by integration of a pitch frequency obtained by linear interpolation of matched fundamental frequencies between successive frames;

determining a pitch onset time by locating the time at which the phase function crosses the nearest multiple of the phase synchrony point; and allocating phase values to the frequency components, such that all of the frequency components come into phase every pitch onset time.

11. A system for processing an acoustic waveform, the system comprising sampling means for sampling a waveform to obtain a series of discrete samples and constructing therefrom a series of frames, each frame spanning a plurality of samples, analyzing means for analyzing each frame of samples to extract a set of variable frequency components having individual amplitudes, tracking means for tracking said components from one frame to a next frame, said tracking means including matching means for matching a component from the one frame with a component in the next frame having a similar value regardless of shifts in frequency and special energy, interpolating means for interpolating the values of the components from the one frame to the next frame, including means for performing an overlap-and-add function utilizing Fourier analysis to generate a reconstruction of said waveform.

12. The system of claim 11 wherein said interpolating means further includes mid-frame estimating means for estimating mid-frame values and means for interpolating between said mid-frames values and values obtained during each frame in order to generate a refined representation of the waveform.

13. The system of claim 12 wherein said mid-frame estimating means further includes means for linearly interpolating the amplitude and frequency values of the lagging and leading sin waves to obtain mid-frame values.

14. The system of claim 12 wherein said mid-frame estimating means further includes means for deriving mid-frame phase values such that sine waves corresponding to the interpolated mid-frame values of the parametric representation is best fit to predetermined segments of lagging and leading sine waves.

15. The system of claim 12 wherein said mid-frame estimating means further includes means for deriving mid-frame phase values from lagging and leading sine waves according to the following equation:

$$\theta(\overline{M})=(\theta_o+\theta_1)/2+(\omega_o-\omega_1)/2.N/4+\pi M$$

where M is an integer whose value is chosen, such that $\pi M$ is closest to $$(\theta_o-\theta_1)/2+(\omega_o+\omega_1)/2.N/4$$

and where $\theta_o$ is the phase of the lagging frame, $\theta_1$ is the phase of the leading frame, ωhd o is the frequency of the lagging frame, $\omega_1$ is the frequency of the leading frame, and N is the analysis frame length.

16. The system of claim 11 wherein said system further includes means for suppressing tonal values.

17. The system of claim 16 wherein said system further includes noise estimating means for estimating a noise envelope and a filter means for suppressing tonal noise values in response to said noise envelope estimate.

18. The system of claim 16 wherein said system further includes a broadband noise generator to replace said suppressed noise values with broadband noise.

19. A receiver for receiving a coded parametric representation of an acoustic waveform in which the representation comprises as set of variable frequency components having individual amplitudes defining sine waves which can be summed to recreate the waveform at a particular frame of time, the receiver comprising:

decoding means for extracting a set of frequency components having individual amplitudes from each frame of a coded representation of an acoustic waveform;

tracking means for tracking said components from one frame to a next frame, said tracking means, including matching means for matching a component from the one frame with a component in the next frame having a similar value regardless of shifts in frequency and spectral energy; and interpolation means for interpolating the values of the components from the one frame to the next frame, including means for performing an overlap-and-add function utilizing Fourier analysis, to generate a reconstruction of said waveform.

20. The receiver of claim 19 wherein said interpolating means further includes mid-frame estimating means for estimating mid-frame values and means for interpolating between said mid-frames values and values obtained during each frame in order to generate a refined representation of the waveform.

21. The receiver of claim 20 wherein said mid-frame estimating means further includes means for linearly interpolating the amplitude and frequency values of the lagging and leading sine waves to obtain mid-frame values.

22. The receiver of claim 20 wherein said mid-frame estimating means further includes means for deriving mid-frame phase values such that sine waves corresponding to the interpolated mid-frame values of the parametric representation is best fit to predetermined segments of lagging and leading sine waves.

23. The receiver of claim 20 wherein said mid-frame estimating means further includes means for deriving mid-frame phase values from lagging and leading sine waves according to the following equation:

$$\theta(\overline{M})=(\theta_o+\theta_1)/2+(\omega_o-\omega_1)/2.N/4+\pi M$$

where M is an integer whose value is chosen, such that $\pi M$ is closest to $$(\theta_o-\theta_1)/2+(\omega_o+\omega_1)/2.N/4$$

and where $\theta_o$ is the phase of the lagging frame, $\theta_1$ is the phase of the leading frame, $\omega_o$ is the frequency of the lagging frame, $\omega_1$ is the frequency of the leading frame, and N is the analysis frame length.

24. The receiver of claim 19 wherein said system further includes means for suppressing tonal values.

25. The receiver of claim 24 wherein said system further includes noise estimating means for estimating a noise envelope and a filter means for suppressing tonal noise values in response to said noise envelope estimate.

26. The receiver of claim 24 wherein said system further includes a broadband noise generator to replace said suppressed noise values with broadband noise.

* * * * *